United States Patent [19]

Schächter

[11] Patent Number: 4,496,309

[45] Date of Patent: Jan. 29, 1985

[54] LIQUID GAS-OPERATED LIGHTER, PARTICULARLY POCKET LIGHTER

[76] Inventor: Friedrich Schächter, Draschestrasse 31, A-1232 Vienna, Austria

[21] Appl. No.: 444,594

[22] PCT Filed: Mar. 18, 1982

[86] PCT No.: PCT/AT82/00004

§ 371 Date: Nov. 19, 1982

§ 102(e) Date: Nov. 19, 1982

[87] PCT Pub. No.: WO82/03262

PCT Pub. Date: Sep. 30, 1982

[30] Foreign Application Priority Data

Mar. 19, 1981 [AT] Austria ..... 1306/81

[51] Int. Cl.[3] ..... F23D 13/04

[52] U.S. Cl. ..... 431/344; 138/41; 138/43; 138/45; 239/533.1; 239/570

[58] Field of Search ..... 431/344; 251/120, 121; 222/3; 138/42, 43, 41, 45; 239/533.13, 533.14, DIG. 18, 570, 571, 533.1

[56] References Cited

U.S. PATENT DOCUMENTS

| | | | |
|---|---|---|---|
| 2,675,205 | 4/1954 | Fortin | 251/121 |
| 3,326,242 | 6/1967 | Parkison | 138/46 |
| 3,592,237 | 7/1971 | Borschers | 138/43 |
| 3,697,002 | 10/1972 | Parkison | 239/533.14 |
| 3,766,946 | 10/1973 | Corarg | 138/44 |
| 3,860,385 | 1/1975 | Nakanishi | 431/344 |
| 4,060,202 | 11/1977 | Neyret | 239/579 |

*Primary Examiner*—Samuel Scott
*Assistant Examiner*—Allen J. Flanigan
*Attorney, Agent, or Firm*—Toren, McGeady and Stanger

[57] ABSTRACT

Liquid gas-operated lighter, particularly pocket lighter, comprising a closable valve at the opening of a valve bore which valve is in communication with a burner tip, a fuel tank and a non-adjustable control device for the flame height arranged between tank and valve bore. The control device is provided with a fuel-permeable proportioning disk of porous material which, on its side facing the fuel tank, is tightly pressed in its border region against a surface which is ring-shaped, preferably circular ring-shaped, by means of a structural component having a passage for the fuel. The annular surface (13) surrounds a recess (12*a*), which has an end face; the end face, together with the recess and the proportioning disk (14), forms a proportioning chamber which is in communication with the burner tip (4) exclusively through the valve bore (11). The end face (2') of the recess is provided totally or partially with a structure having recessed portions and possibly projections which maintain a constant connection between the proportioning chamber and the valve bore. When the valve is open, the proportioning disk of microporous film having microscopically small individual pores rests against the end face so as to close more and more pores as the pressure difference increases in dependence upon the temperature.

9 Claims, 8 Drawing Figures

LIQUID GAS-OPERATED LIGHTER, PARTICULARLY POCKET LIGHTER

The invention relates to a liquid gas-operated lighter, particularly pocket lighter, comprising a closable valve at the opening of a valve bore which valve is in communication with a burner tip, a fuel tank and a non-adjustable control device for the flame height arranged between tank and valve bore. The control device is provided with a fuel-permeable proportioning disk of porous material which, on its side facing the fuel tank, is tightly pressed in its border region against a surface which is ring-shaped, preferable circular ring-shaped, by means of a structural component having a passage for the fuel.

A method for manufacturing a lighter of the above-mentioned type represents a further subject matter of the invention and includes a computer-controlled or microcomputer-controlled measurement as an integral method step.

In the lighters heretofore known, manufacturing inconsistencies occur which cause within a production series significant deviations of the flow rate of the fuel from the desired rate. Moreover, it had to be accepted in the past that the influence of the gas vapor pressure has a proportional, or even more than proportional, effect on the flame height when the temperature increases. Since the manufacturing inconsistencies of the porportioning disk material and the temperature influence are compounded, the user is frequently startled by an unexpectedly high flame. This represents a substantial safety problem because a startle reaction of the user might cause accidents. Therefore, a majority of the disposable lighters offered on the world market at very low prices have a mechanism which permit the owner to control the flame height. As a result, the manufacturing costs are substantially increased, and the safety problem is still not solved because the necessity of reducing the flame height is recognized only after the startle reaction. Therefore, various countries are considering introducing legal limitations for pocket lighters, according to which maximum flame heights may not be exceeded. Therefore, in the mass production of lighters without flame regulating devices, an important problem resides in controlling the flame height in such a manner that the flame height does not deviate more than $+/-10\%$ as compared to a desired value under equal temperature conditions. However, due to the temperature dependency of the vapor pressure, the amount of gas discharged inevitably increases and, thus, the flame height increases with rising temperature, wherein the flame height must meet the legal requirements even in the case of the maximum vapor pressure to be expected during practical use.

For example, assuming a normal flame with a height of 25 mm at 25° C. and 2.5 bars pressure, a temperature increase to 50° C. results in the known lighters in an increase of the pressure to 5 bars in the case isobutane gas is used. This, as well as an additional, non-linear, increased permeability of the proportioning disk caused by thermal expansion, leads to an increase of the flame height to 50 to 70 mm. If the observed change of the flame height at a desired temperature change is defined the flame index, and if the index value 1 is assigned to an increase of the flame from 25 to 50 mm when the temperature rises from 25° to 50° C., a flame height increase from 25 to 70 mm would correspond to a flame index of 1.8.

Experience has shown that in known small lighters the aging in the unused state additionally leads to an irreversible change of the originally adjusted flame characteristic. This is particularly true when the lighters are subjected to changing or extreme ambient conditions, and when the bracing elements for the proportioning disk consist of materials having different thermal expansions.

Also, a flickering of the flames can be frequently observed. This is particularly true for pocket lighters which are subjected to very different temperatures and are frequently in a completely undefined carrying position immediately prior to being used.

Some of these deficiencies are not as disadvantageous in pocket lighters which are provided with a flame-regulating device as in lighters in which a non-adjustable control device for the flame height is provided.

Flame-regulating devices are known (U.S. Pat. No. 3,766,946) in which an elastic body can be placed against a porous body, for example, of a sintered metal, and the elastic body is deformed depending upon the magnitude of the contact pressure and rests with a more or less large surface area against the porous body and, thus, changes the cross-sectional area of flow in the porous body.

Furthermore, it is known to use a porous membrane for the controlled limitation of the gas flow. Such devices are disclosed in French Pat. No. 2,313,638 (with flame-regulating device) and No. 2,313,639 (without flame-regulating device). In a metal valve body arranged between liquid gas tank and burner, the porous membrane is inserted on the side facing the liquid gas tank, the porous membrane being covered at least on the side facing away from the tank with a fiber layer and being arranged braced in the valve body in a gas-tight manner by means of a pressure body consisting of a poorly heat conducting plastics material. The devices are based on the concept that, for a satisfactory operation, the side of the membrane facing the liquid gas tank should always be filled with the liquid phase of the gas in a free area, and that this liquid gas flows through the pores of the membrane, in order to vaporize on the other side facing away from the liquid gas tank with the assistance of the fiber layer. For this purpose, a wetting chamber is provided on the side of the membrane facing the tank, liquid gas being supplied continuously to the wetting chamber from the liquid gas tank through a dip pipe. A vaporization chamber is provided on the side of the membrane which is covered with the fiber layer, the vaporization taking place when the stop valve located there-above is opened. To prevent a vaporization already in the wetting chamber and thus, a flickering, unsteady burning of the flame, the above-mentioned French Pat. No. 2,313,629 suggests to make the pressure body of a poorly heat conducting plastics material.

This disclosed device does not provide fully satisfactory results because of the summation of several factors which influence the amount of gas actually passing through, such as, the unavoidable variations in the porosity of the membrane material and the structural inconsistencies of the fiber material, as well as the deformation of the wetting chamber diameter due to the contact pressure during the assembly of the device. In addition, the dip pipe cannot prevent the formation of vapor bubbles in the liquid column which can be caused, for example, by changes in the position of a pocket lighter. This has the result, inter alia, that the flame flickers or suddenly become smaller. Therefore, for improving the problem mentioned last, a precision wick is inserted in practice in the known lighters instead of the dip pipe. The high costs of the wick substantially increase the manufacturing costs. In spite of this increase in cost, the differences in the flame height are still unsatisfactory because the space including the vaporization chamber and the valve bore has a relatively large volume and, therefore, the liquid gas collected in this space is responsible for a dangerously, although very short, shooting flame immediately after ignition. This is particularly true for the lighter according to French Pat. No. 2,313,638 whose membrane porosity is adjusted for a relatively high flame which is appropriate in such lighters having a flame-regulating device.

When a dip pipe or a precision wick are used, a voluminous, poorly heat conducting plastic part of high stiffness is required for fastening the dip pipe or precision wick and for bracing the membrane. As a result, the dimensions of the metal part surrounding the plastic part become relatively large. The large volume of the required parts leads to relatively high manufacturing costs.

Due to the differences in the thermal expansion between the plastics material for the pressure body suggested because of its poor heat conductivity and the metal valve body receiving the pressure body, the bracing forces acting on the membrane change as the temperature changes and may be subjected to irreversible weakening. The cutting of the proportioning disk from a film with the use of ultrasonics and the subsequent fastening to the bracing body, the then following insertion of this preassembled unit into the deep blind-end hole of the metal valve body and the gas-tight flanging are difficult and may easily lead to defective valve units which then are unusable rejects.

It is the object of the present invention to provide a device which facilitates a better constancy of the gas flow. When the device is used in lighters, the flame index should be smaller than 0.9 and the shooting flame is to be avoided, so that the safety is increased and the economical utilization of the fuel is improved. Further, the invention is to ensure a substantial reduction of the flickering tendency, is to facilitate a marked reduction of the manufacturing costs and, furthermore, the device in accordance with the invention is to be capable of easier assembly than the solutions known in the past.

This object is met in a lighter of the above-mentioned type in that, in accordance with the invention, the annular surface surrounds a recess which, together with the proportioning disk and the end face of the recess, forms a proportioning chamber which is in communication with the burner tip exclusively through the valve bore, and that the end face of the recess is provided totally or partially with a structure having recessed portions and possibly projections which maintain a constant connection between the proportioning chamber and the valve bore. When the valve is open, the proportioning disk of microporous film having microscopically small individual pores rests against the end face so as to close more and more pores as the pressure difference between the pressure in the tank and the ambient pressure increases in dependence upon the temperature.

Advantageously, the structure of the end face contains ray-like extending grooves having V-shaped cross-sectional areas with mounds being provided adjacent the side edges of the grooves, wherein the depth of the grooves relative to the level of the unstructured surface areas (stop-down surfaces) is a multiple of, preferably 5 to 12 times, the height by which the mounds project above this level.

The proportioning disk is provided with a very large number of submicroscopic, closely adjacent, preferably unconnected pores of slot-like cross-section, and preferably consists of a material which, when the device is used within a temperature range of from minus 30° to plus 70° C., maintains unchanged its temperature proportional properties with respect to the permeability to fuel.

In the following, several embodiments are illustrated with the aid of the drawings, without limiting the invention to these embodiments.

Figure 1:
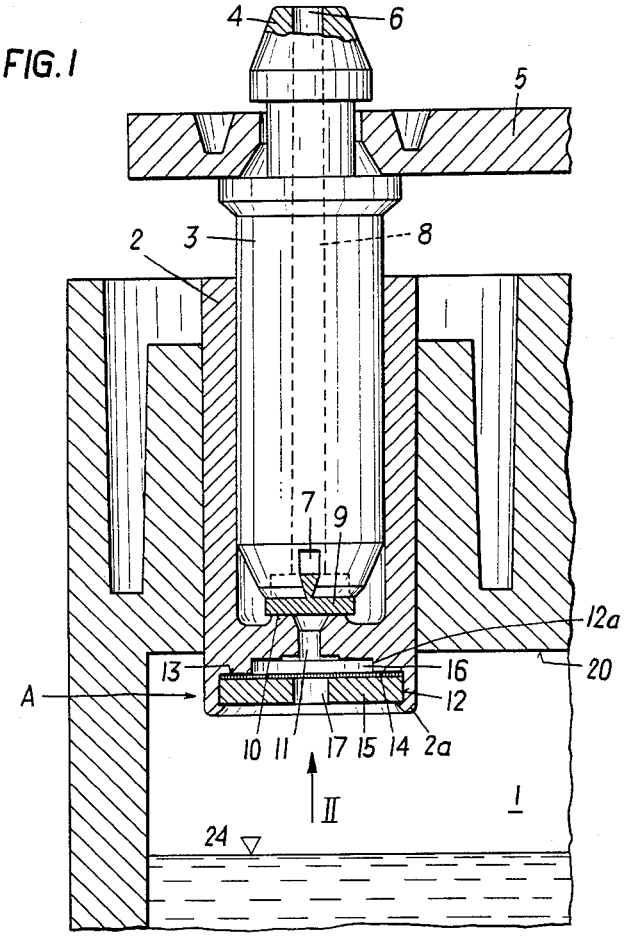
FIG. 1 is a partial sectional view of a lighter which is equipped with a control device according to the invention. For clarity's sake, all those parts which are not necessary for the explanation of the invention are not illustrated.

FIG. 1 is a cross-sectional view of that portion of a lighter which receives the control device according to the invention for obtaining a constant flame height. A valve body 2 is pressed in a gas-tight manner into the upper wall of the liquid-gas tank 1. In a bore on the side facing away from the liquid-gas tank, the valve body 2 receives a displaceable burner pipe 3. At its upper end, the burner pipe 3 has a burner tip 4 underneath which actuating lever 5 engages. An axial gas discharge bore 8 opening into the burner nozzle 6 extends through the burner pipe 3 to a transverse hole 7. At the lower end of the burner pipe 3, a sealing disk 9 is arranged which interacts with a valve seat 10 of the valve body 2. When the lighter is not used, a spring, not shown, presses the burner pipe 3 downward against the valve seat 10, thereby closing the valve bore 11.

The valve body 2 preferably consists of Ms 58 with about 2% lead. Into the side of the valve body 2 facing the liquid-gas tank 1 there is advantageously cut a blind hole-like recess 12 in which a proportioning disk 14 is pressed by means of a bracing disk 15 against a preferably plane annular surface 13 of the recess 12 in such a way that the proportioning disk 14 is compressed to approximately half its thickness and the bracing surface thereby becomes impermeable to gas. The bracing disk 15 and the proportioning disk are fixed in this state by flanging the edge 2*a* of the valve body 2.

At least in the bracing area, the bracing disk 15 has a surface which geometrically coincides with the annular surface 13 and ensures the gas-tight bracing of the proportioning disk rim. The bracing disk 15 is connected to the liquid-gas tank 1 through a gas passage 17.

The recess 12 in the valve body 2 is provided with a second recess 12*a* whose end face 2′ has a distance of, for example, 0.1 mm from the annular surface 13 of the recess 12. Together with the recess 12*a* and the end face 2′, the side of the proportioning disk 14 facing away from the liquid-gas tank 1 forms a proportioning chamber whose depth is two to eight times, preferably three to four times, the thickness of the proportioning disk 14. The cross-sectional area of the proportioning chamber 16 perpendicularly to the axis of the proportioning disk 14 determines the size, position and shape of the surface of the proportioning disk 14 exposed to the fuel. Generally, this surface will be circular. However, it can also have another shape. In the latter case, the diameter of a circular area of equal size is designated the hydraulic diameter of the surface deviating from the circular shape.

The gas passage 17 in the bracing disk 15 must be smaller than the hydraulic diameter of the proportioning chamber 16. The thickness of the bracing disk 15 is smaller than the hydraulic diameter of the proportioning chamber 16, preferably smaller than one-third of the hydraulic diameter.

It is advantageous to construct the bracing disk of a metal material, preferably of so-called machining brass (an alloy of 58% Cu, 2%, Pb, remainder Zn) because, due to the high compressive strength of such materials, a reliable bracing of the proportioning disk 14 is made possible. Preferably, the valve body 2 is made of the same material, so that the thermal expansion of the parts surrounding the membrane remains the same when the temperature varies.

The proportioning disk 14 is composed of a microporous plastic film, wherein the transport of the liquid gas in the liquid and/or gaseous phase is effected through the disk essentially prependicularly to the surface. Particularly suitable for this purpose is a microporous, uniaxially stretched polypropylene film having a thickness of between 15 and 40 micrometers, preferably between 22 and 27 micrometers, and having slot-like pores with a cross-sectional area of about 0.04 by 0.4 micrometers produced during the stretching preferably in the extrusion direction. At a gas vapor pressure of 1 to 6 bars, the fuel amount flowing through is essentially linear to the pressure. Such a product is sold at the present time, for example, by Celanese Plastics Company, S.C., U.S.A., under the trade name "Celgard ®2500".

Figure 2:
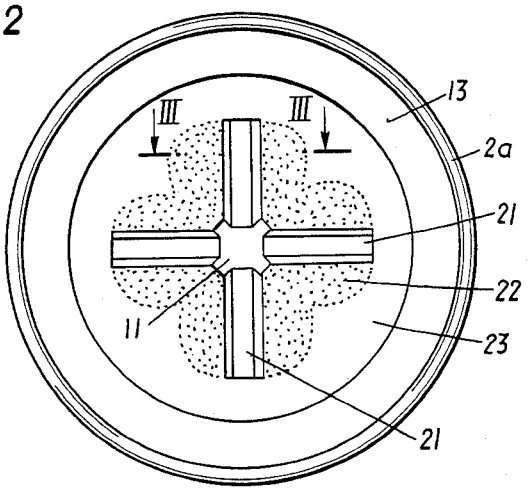
FIG. 2 is a bottom view of the proportioning chamber, on a larger scale, the bracing disk and the proportioning disk having been removed.
Figure 3:
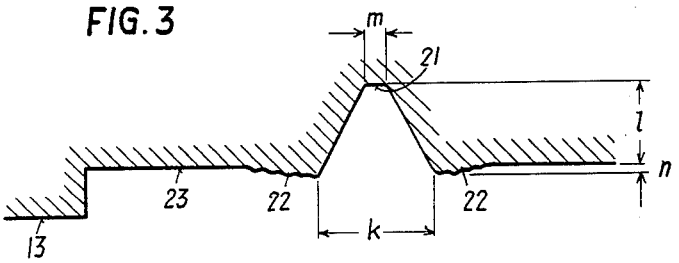
FIG. 3 is a sectional view along line III—III of FIG. 2, on a larger scale.
Figure 4:
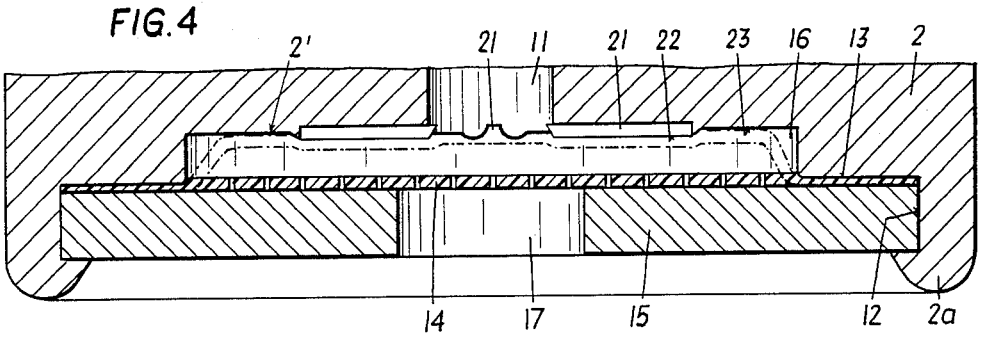
FIG. 4 is a longitudinal section of part A of FIG. 1, on a larger scale.
Figure 5:
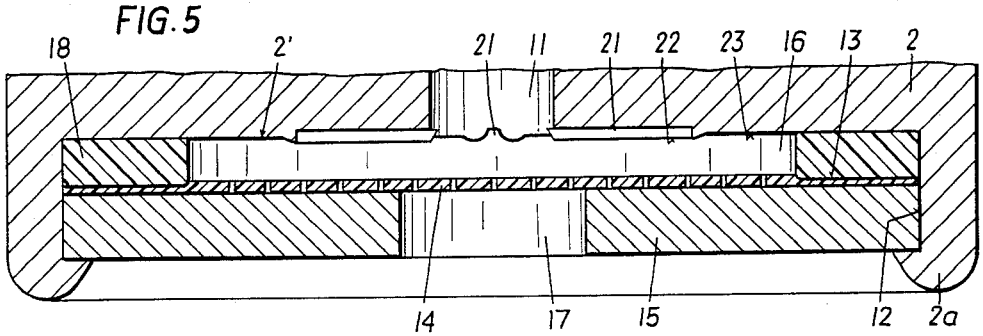
FIGS. 5, 6 and 7 are longitudinal sections of various embodiments of the control device according to the invention.

In FIGS. 4 and 5, the valve body 2 is structured at the end face 2' forming the bottom of the proportioning chamber 16, with the exception of a circumferential area 23. The structure 22 may have any type of relative projections and recessed portions. Advantageously, the structure can consist of ray-like grooves 21. FIG. 2 shows as an embodiment a four-arm groove star. However, it is within the scope of the invention to choose any number of arms. For example, five, six or eight arms may be provided. These grooves 21 are preferably stamped in a single stamping procedure, namely by means of a stamping tool which has several ray-like arranged cutting edges of V-shaped cross-section, the number of cutting edges corresponding to the number of arms. As FIG. 3 shows an enlarged scale, the depth l of the grooves 21 can be 0.09 mm, the opening can have a width k of 0.14 mm and the bottom m can have a width of 0.03 mm. The mound-like edge regions 22 adjacent to the sides of the groove 21 are somewhat rough because the structure of brass (containing about 2% lead for good cutting properties) is slightly broken during upsetting, i.e., the grain structure is disrupted. The resulting height n is about 0.01 mm. However, the groove star can also be stamped by means of a stamping tool which has at least one cutting edge, wherein the stamping tool is rotated about its longitudinal axis by a defined angle between the individual stamping procedures until the desired amount of arms is formed.

Of course, other manufacturing methods can also be used, for example, etching, sandblasting, electroerosion or the like.

It is the purpose of the diameter of the proportioning chamber 16 to keep a defined cross-sectional area of the proportioning disk free for the passage of gas. The depth of the proportioning chamber 16 is coordinated with the flexibility of the elastically deformable proportioning disk 14 in such a way that the desired amount of gas is allowed to pass through. For example, the depth of the proportioning chamber can be coordinated with the unstructured surface area 23 in such a way that, if the gas pressure prevailing in the tank increases due to a temperature rise and the membrane is thereby pressed against the area 23, a portion of the pores is stopped down, the portion growing proportionally with increasing pressure; this is further reinforced by the thermal expansion of the membrane material. As a result, the flame height increases to a lesser extent than the increase of gas pressure would have otherwise effected. The flame index can thus be kept smaller than 0.9. When the proportioning disk material has a thickness of 25 micrometers, a depth of the proportioning chamber 16 of, for example, 0.08 to 0.12 mm is advantageous, with the proportioning chamber having a diameter of from 1.8 to 1.9 mm and the star having a diameter of 1.3 mm. The above dimensions are with reference to a quality of "Celgard ®2500" whose porosity results in a measured value of 7.5 Gurley seconds in accordance with ASTM test method D-726, Model B.

The proportioning disk 14 is flexible because of its small thickness. Accordingly, the proportioning disk 14 yields in the direction of the valve bore 11 under the flow pressure and rests against the end face 2'. When the temperature and pressure increase, the thermal expansion coefficient of the proportioning disk 14 causes it to rest with an increasingly large portion against the non-structured area 23 of the end face 2' without exceeding the yield strength of the material, so that a portion of the pores is stopped down, this portion being greater than a proportional portion, while the grooves 21 and the structure 22 enable the gas to flow into the valve bore 11. After the return to normal pressure, the membrane again lifts off the stop-down area 23, whereupon the amount flowing through again exactly corresponds to the original amount, because no irreversible stretching and change of the porosity have taken place if the conditions have been correctly interpreted (FIGS. 3 and 4).

In a lighter burner in which a "Celgard ®2500" membrane with a Gurley value of 7.5 is used and mounted in a valve body having an internal diameter of 3.5 mm, and which has a bracing disk with an external diameter of 3 mm and a proportioning chamber having a diameter of 1.8 mm and a depth of 0.1 mm, and with a six-arm star having a diameter of 1.3 mm, a device according to the invention results in a flame height of 25 mm (normal flame) at an ambient temperature of 25° C., using about 1 milligram fuel per second. A change of the proportioning chamber diameter leads to a proportional change of the flame height. Consequently, if the membrane material corresponds exactly to the desired value, a different flame height can be obtained, or, after determining a deviation of the Gurley value of the membrane material charge to be used, an appropriate proportioning chamber diameter can be determined in order to obtain a desired flame height.

Surprisingly, the device according to the invention, the difference with respect to weight of the amount of fuel passing through in the liquid and the gaseous phases of the gas tank filling is not very great.

Therefore, the lighters according to the invention having no dip pipe or wick permit a manipulation in an inclined position (for example, for lighting a pipe), the flame becoming only insignificantly larger even though the liquid tank content comes into contact with the gas passage 17.

Moreover, a quiet and uniform burning of the flame in the normal, vertical position of operation is achieved by an arrangement of the control device which excludes a direct contact of the proportioning disk 14 with the liquid phase of the tank filling. When the lighter is moved from an undefined, for example, horizontal carrying position into a vertical position for ignition, the liquid fuel, with the exception of a residual amount retained by surface forces, flows from the space situated in front of the proportioning disk 14 into the tank 1, so that the proportioning disk 14 is separated from the liquid level 24 of the fuel.

Since the thickness of the bracing disk 15 is not greater than the hydraulic diameter of the proportioning chamber 16, the volume of the space situated in front of the proportioning disk 14 is small. Since, also due to the low surface tension and viscosity of the liquid phase of the fuel, the flow resistance is low during flow-off, any possibly retained residual amount of the fuel, relative to the cross-sectional area of the proportioning disk available for the passage of gas, is so small that it runs off, evaporates or burns in a short time, for example, in about 1 second. If any spontaneous, bubble-forming boiling of liquid fuel occurs at all on the side of the proportioning disk 14 facing the tank 1, the amount available for boiling is evaporated after a short time. Therefore, except for a very short start-up time, gas passes through the proportioning disk 14 exclusively from the gaseous phase of the fuel, so that a quietly and uniformly burning flame is obtained.

The effect can be improved in a simple manner by various measures.

An improvement of the flow-off of the liquid phase as complete as possible during moving the burner into the vertical position is achieved by making the surface of the bracing disk 15 non-wettable. This can be achieved, for example, by coating it with fluorinated hydrocarbon compounds, for example, polytetrafluoroethylene.

When the bracing disk 15 is made non-wettable, it is advantageous to have a diameter of the gas passage 17 of such a small size in relation to the hydraulic diameter of the proportioning chamber 16 that capillary forces promote the flow-off of the fuel from the proportioning chamber 16 and only small residual amounts of the liquid phase can remain. The space of the gas passage 17 is not even filled with liquid gas because, if the valve—as usual—has been closed while the lighter is still in the vertical position, no liquid gas can reach the passage even when the lighter is subsequently carried in the pocket in any possible position.

However, if the bracing disk 15 has a wettable surface, the effect in accordance with the invention can be improved by geometrically constructing the passage 17 in such a way that capillary effects are avoided.

Furthermore, the flame can be stabilized after ignition especially quickly when the valve body 2 projects into the liquid-gas tank in such a way that the size of the projection corresponds approximately to the depth of the recess 12, so that the proportioning disk 14 is located approximately in the plane of the liquid-gas tank ceiling 20 of the liquid-gas tank 1.

While a preferred embodiment according to the invention achieves the intended effect by a proportioning from the gas phase, the known solutions attempt to obtain a wetting of the porous membrane with the liquid phase which is as complete and constant as possible. In these cases, due to the thermodynamic conditions, a boiling with a spontaneous or periodic bubble formation cannot be avoided, even if, in accordance with the proposal of French Pat. No. 2,313,639, the bracing body is constructed so as to be thermally insulating. A flame index of 1.1 to 1.3 must be expected.

When, for example, isobutane is used, the saturation vapor pressure of the liquid gas does not depend upon the filling level of the liquid-gas tank 1. Since the present invention takes the gas from the gaseous phase of the tank filling, its effect is completely independent from the filling level of the liquid-gas tank 1.

Figure 6:
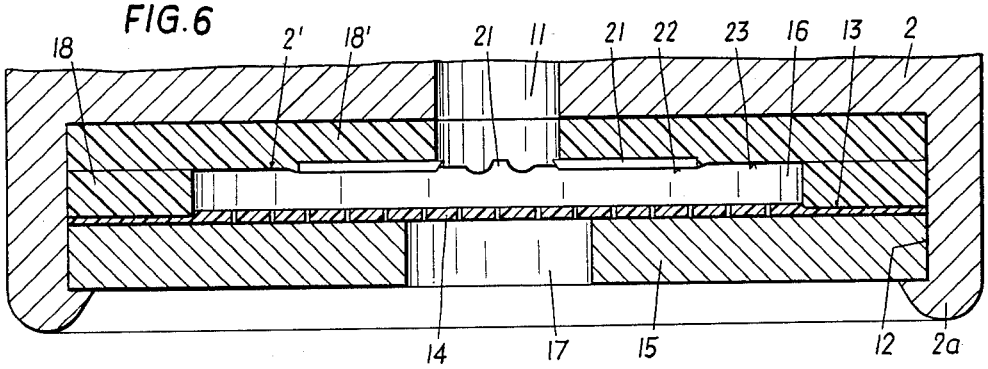
Figure 7:
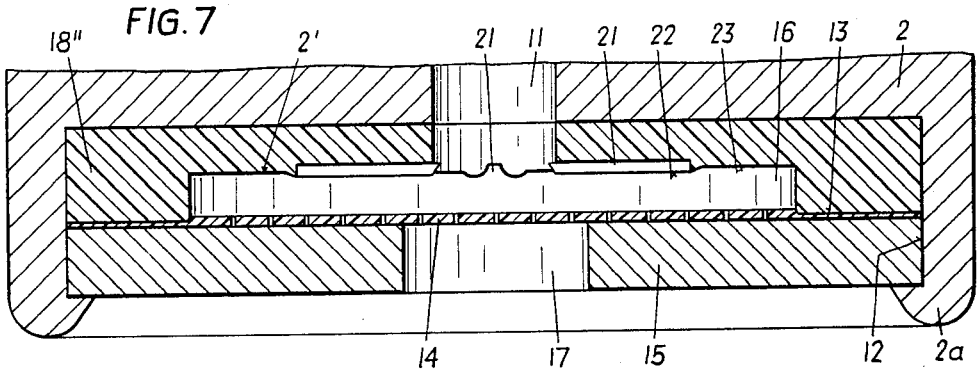

Further advantageous embodiments of the invention are explained with the aid of FIGS. 5 to 7, each illustrating a cross-sectional view of the lower portion of the valve body 2 in the region of the recess 12. All reference numerals are selected in accordance with FIG. 1 and FIG. 2.

The proportioning chamber 16 is formed in FIG. 1 by a second recess **12*a* in the recess 12. In the embodiment according to FIGS. 5 and 6, on the other hand, the proportioning chamber is laterally limited by the spacer ring 18 which, as is true for the proportioning disk 14, is braced in a gas-tight manner by the bracing disk 15. The spacer ring 18 consists of a plastics material of high stiffness, compressive strength, dimensional stability under heat, and preferably low thermal conductivity. Particularly suitable for this purpose are structural components of polyimide, for example, a type manufactured by Du Pont under the trade name "Kapton®". This material primarily has also the advantage that it has approximately the same thermal expansion as brass, so that, when the valve body 2 and the bracing disk 15 are made of machining brass, no thermal tensions impair the function of the device in accordance with the invention. The spacer ring 18 can easily be stamped from commercially available films, which facilitates a very inexpensive production and permits an easy adjustment of the diameter of the proportioning chamber. Moreover, the plastics material of the spacer ring 18 promotes the sealing action of the bracing surface and, during assembly, reduces the danger of an unintentional squeezing of the proportioning disk 14 at the edge of the proportioning chamber 16**.

The embodiments according to FIGS. 6 and 7 correspond essentially to that of FIG. 5, however, an intermediate layer 18' (FIG. 6) is arranged between the proportioning disk 14 and the bottom of the recess 12, wherein the bottom of the proportioning chamber 16 formed by the intermediate layer 18' has the structure. The intermediate layer 18' consists preferably of the same plastics material as the spacer ring 18 and is structured on its side facing the proportioning disk.

In the embodiment according to FIG. 7, the recess 16 is formed in a body 18'' which simultaneously has the functions of the spacer ring 18 according to FIG. 5 and the intermediate layer 18' according to FIG. 6.

Finally, there exists the possibility of constructing the structure 22 in any combination of the shapes of the projections and recesses.

The manufacturing costs of the device in accordance with the invention are substantially reduced just by the fact that no large structural components are required which would lead to high costs for material. Also, the costs for the mechanical finishing of the structural components are low because it is not necessary to remove large amounts of material and no work with exacting requirements must be performed at locations which are not easily accessible, for example, in deep blind-end holes.

Since the required small parts are all arranged in very shallow recesses, the mounting of these parts is also free of problems and can be performed with relatively simple devices. This makes unnecessary, for example, the preassembly of the membrane by means of ultrasonic welding as it is described in French Pat. No. 2,313,638.

Moreover, the small dimensions of the structural components prevent the occurrence of great thermal expansions or thermal tensions which impair the thermal stability of the flame height. This effect can be further improved by suitable selection of materials which ensure, for example, the same thermal expansion coefficient for all structural components having tensile stiffness. The arrangement of thermally insulating structural components, such as, the spacer ring 18, ensures a further improvement of the thermal stability.

Figure 8:
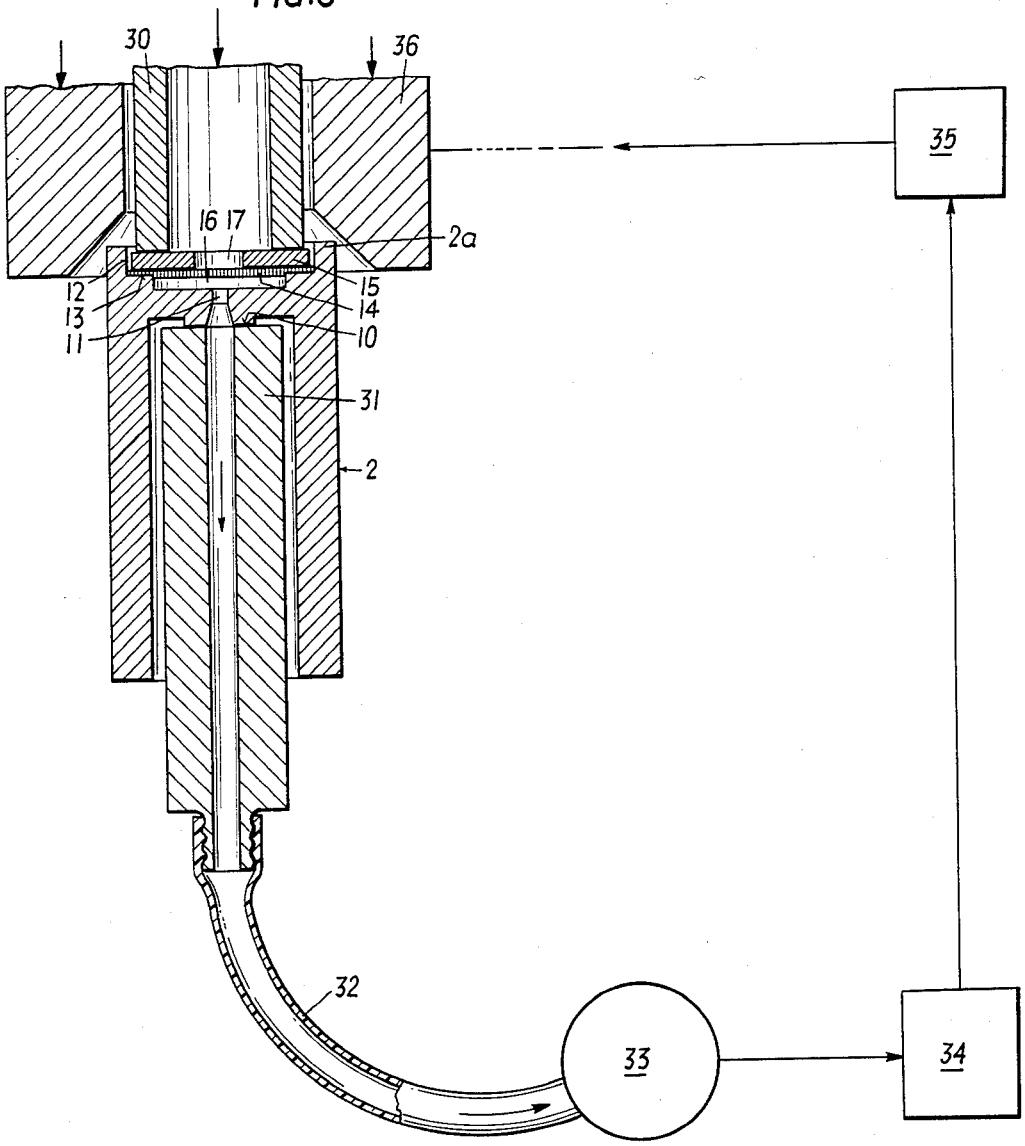
FIG. 8 shows a testing and flanging device.

The usually occurring manufacturing inconsistencies which may lead to substantial differences in the flame height within one production series can be substantially improved in an economical manner by the device in accordance with the invention. The simplicity of the required structural components facilitates a high constancy in quality. The arrangement of all small parts in easily accessible, shallow recesses also reduces the probability of incorrect assembly. Moreover, it makes possible a check of the gas permeability of the proportioning disk 14 in a simple manner, as well as a selection in accordance with the observed inconsistencies. This can be done, for example, in the following manner:

After loosely inserting the proportioning disk 14 and the bracing disk 15 in the recess 12 of the valve body 2, a measuring pipe 30 (FIG. 8) through whose interior a gas, for example, air can be conducted under exact control of pressure and temperature, is pressed against the bracing disk with about 200N, so that the periphery of the proportioning disk is compressed and becomes impermeable to gas in the area of the annular surface 13 and the gas flow now corresponds to the hydraulic diameter of the proportioning chamber 16. The valve seat 10 preferably rests on the support pipe 31 which is connected to a flow sensor 33 through a connecting pipe 32. The measured values generated by the sensor are processed by a computer which controls an electrically operated orientation mechanism 35 of the assembly machine. The measurement is carried out at a temperature of 25° C., so that the above-described stop-down effect of a portion of the pores has not yet become effective. Concentrically surrounding the measuring pipe 30 is an axially movable flanging tool 36 whose axial movement can be released by the mechanism and which does not yet act on the rim *2a* of the valve body 2 during the measurement. By means of the very quickly reacting flow sensor 33, the amount of gas flowing through the proportioning disk 14 is measured within less than 0.2 seconds and, thus, facilitates an exact conclusion with respect to the flame height. The measurement is supervised by the computer which processes the deviations from the desired value and decides whether in parts which are accepted the flanging is to be carried out, or whether the proportioning disk and the bracing disk are discharged in a subsequent work station and the more valuable valve body again reaches the test station equipped with a new proportioning disk. The bracing disks which have been discharged are collected and can be used once again, while the proportioning disks having too large or too small a gas passage can no longer be used. It is important that, from the moment the bracing disk 15 which is subjected to the pressure of the measuring pipe 30 acts on the proportioning disk periphery until the flange of the rim *2a* has been completed, the contact pressure is not reduced because otherwise the material of the proportioning disk would lose its original, for example, circular shape due to the uniaxial stretching, and an indeterminable portion of the proportioning disk periphery, after losing its porosity due to the shrinking, would rest over the proportioning chamber cross-section, so that the amount of gas during and after the measurement would no longer coincide.

In known embodiments, measures for checking the amount flowing through are significantly more complicated, and unsuitable parts cannot be separated from usable parts because the parts are processed and assembled before the defectiveness is determined.

Another advantage of the device according to the invention concerns the change of the originally adjusted flame characteristic due to aging which frequently occurs even without use of the lighter. Using a microporous, uniaxially stretched polypropylene film, preferably of "Celgard ®2500" as the material for the proportioning disk 14 without the use of a fiber layer or the necessity of a wick, results in a very high aging stability of the device according to the invention with respect to the constancy of the flame characteristic. Although the burner of a lighter has been described as an embodiment, the device can also be used in containers for the distribution of perfume, insecticides, medicines or the like.

The uniaxially stretched polypropylene film is deformable in the non-stretched direction, so that the amount flowing through could be influenced unintentionally. Therefore, it is advisable to construct the diameter of the valve bore 11 in a very small size (for example, 0.35 to 0.5 mm) so that the proportioning disk cannot be pressed in by the gas pressure.

As already mentioned, a preferred embodiment of the device in accordance with the invention does not use a dip pipe or a wick for conveying liquid gas to the membrane, but ensures a space filled with gas vapor between the liquid gas level and the bottom side of the valve body, wherein preferably the pressure body used for bracing the proportioning disk is constructed as a thin bracing disk in order to keep the volume of the gas passage adjacent the proportioning disk at the tank side small, so that the residue of liquid gas retained by the surface forces runs off quickly when the lighter is moved from an undefined, for example, horizontal carrying position, into a vertical position for ignition.

In the production of lighters, such as, non-refillable pocket lighters, the filling amount of the liquid gas must be limited to approximately 80% of the volume of the fuel tank. During the filling procedure, the ambient temperature is about 20° to 25° C. This limitation to 80% is necessary for safety reasons because, during later storage or during the use of the lighters, the liquid fuel may lead to an explosion-like bursting of the tank in the case of substantially higher temperatures, such as, 60° C.

The fact that about 20% of the capacity of the tank must be occupied by the gaseous phase of the fuel is utilized in the lighters in accordance with the preferred embodiment in order to ensure that the proportioning disk and the components serving to brace the proportioning disk do not come into contact with the liquid level of the fuel when the lighter is used in the vertical position.

I claim:

1. Liquid-gas operated lighter, such as isobutane gas operated pocket lighter, comprising a burner tip, a closable valve in communication with said burner tip, a valve bore having first and second openings, said first opening arranged adjacent said closable valve, a fuel tank and a non-adjustable control device arranged between said tank and said valve bore, an annular surface facing said fuel tank and having a recess of limited depth, said recess defining an end face extending transversely to said bore, said end face arranged contiguous with said second opening of said valve bore, a structural component having a passage for fuel, a proportioning disk whose periphery is pressed in a gas tight manner by said structural component against said annular surface, said proportioning disk formed by a fuel-permeable flexible film having microscopically small individual pores permitting flow of gas through said proportioning disk essentially perpendicularly to the film surface, said recess, said end face and said proportioning disk defining a proportioning chamber, said control device being formed by said proportioning disk and said proportioning chamber, so that when said valve is open the pressure in said tank causes said proportioning disk to be deflected in the direction of said second opening into said proportioning chamber toward said end face, a texture including recessed portions formed in the surface of said end face for controlling flow of gas from said proportioning disk toward said valve bore when said proportioning disk is in contact with said end face, said texture in said end face closing more and more pores of said proportioning disk as the pressure difference between the pressure in the tank and the ambient pressure increases in dependence upon the temperature.

2. Liquid-gas operated lighter, such as isobutane gas operated pocket lighter, comprising a burner tip, a closable valve in communication with said burner tip, a valve bore having first and second openings, said first opening arranged adjacent said closable valve, a fuel tank and a non-adjustable control device arranged between said tank and said valve bore, an annular surface facing said fuel tank and having a recess of limited depth, said recess defining an end face extending transversely to said bore, said end face arranged contiguous with said second opening of said valve bore, a structural component having a passage for fuel, a proportioning disk whose periphery is pressed in a gas tight manner by said structural component against said annular surface, said proportioning disk formed by a fuel-permeable flexible film having microscopically small individual pores permitting flow of gas through said proportioning disk essentially perpendicularly to the film surface, said recess, said end face and said proportioning disk defining a proportioning chamber, said control device being formed by said proportioning disk and said proportioning chamber, so that when said valve is open the pressure in said tank causes said proportioning disk to be deflected in the direction of said second opening into said proportioning chamber toward said end face, a texture including projections and recessed portions formed in the surface of said end face for controlling flow of gas from said proportioning disk toward said valve bore when said proportioning disk is in contact with said end face, said texture in said end face closing more and more pores of said proportioning disk as the pressure difference between the pressure in the tank and the ambient pressure increases in dependence upon the temperature.

3. Lighter according to claim 1, characterized in that the depth of said proportioning chamber (16) is two to eight times, preferably three to four times, the thickness of said proportioning disk (14).

4. Lighter according to claims 1, 2 or 3, characterized in that said structure includes grooves (21) extending in a ray-like manner from said valve bore (11).

5. Lighter according to claim 4, characterized in that said grooves (21) have V-shaped cross-sections with mounds (22) being provided at their side edges wherein the depth of the grooves relative to the surface level of said end face (2') is a multiple of, preferably five to twelve times, the height by which said mounds project above this surface level.

6. Lighter according to claim 4, characterized in that at least two, preferably between four and eight, grooves (21) are provided.

7. Lighter according to claim 1, characterized in that said proportioning chamber (16) is arranged in an annular spacer disk (18).

8. Lighter according to claim 1, characterized in that said end face (2') of said recess is formed by an intermediate layer (18').

9. Lighter according to claim 1, characterized in that the pores of said proportioning disk (14) have a cross-sectional area of $0.04 \times 0.4$ μm.

* * * * *